US012344946B2

(12) United States Patent
Shinde et al.

(10) Patent No.: US 12,344,946 B2
(45) Date of Patent: Jul. 1, 2025

(54) STABLE HYDROGEN EVOLUTION ELECTROCATALYST BASED ON 3D METAL NANOSTRUCTURES ON A TI SUBSTRATE

(71) Applicant: FONDAZIONE ISTITUTO ITALIANO DI TECNOLOGIA, Genoa (IT)

(72) Inventors: Dipak Vijaykumar Shinde, Genoa (IT); Liberato Manna, Genoa (IT); Luca De Trizio, Bergamo (IT)

(73) Assignee: FONDAZIONE ISTITUTO ITALIANO DI TECNOLOGIA, Genoa (IT)

( * ) Notice: Subject to any disclaimer, the term of this patent is extended or adjusted under 35 U.S.C. 154(b) by 513 days.

(21) Appl. No.: 17/619,819

(22) PCT Filed: Jun. 18, 2020

(86) PCT No.: PCT/IB2020/055691
§ 371 (c)(1),
(2) Date: Dec. 16, 2021

(87) PCT Pub. No.: WO2020/255005
PCT Pub. Date: Dec. 24, 2020

(65) Prior Publication Data

US 2022/0298657 A1 Sep. 22, 2022

(30) Foreign Application Priority Data

Jun. 21, 2019 (IT) ..... 102019000009753

(51) Int. Cl.
*C25B 11/093* (2021.01)
*C25B 1/04* (2021.01)
*C25B 9/19* (2021.01)

(52) U.S. Cl.
CPC ..... *C25B 11/093* (2021.01); *C25B 1/04* (2013.01); *C25B 9/19* (2021.01)

(58) Field of Classification Search
CPC .... C25B 1/04; C25B 1/02–044; C25B 11/093
See application file for complete search history.

(56) References Cited

U.S. PATENT DOCUMENTS 3,751,296 A 8/1973 Beer
4,581,117 A 4/1986 Asano et al.
(Continued)

FOREIGN PATENT DOCUMENTS

JP 2003146602 A 5/2003

OTHER PUBLICATIONS

Shinde et al., In Situ Dynamic Nanostructuring of the Cu—Ti Catalyst-Support System Promotes Hydrogen Evolution under Alkaline Conditions, 10 ACS Appl. Mater. Interfaces 29583 (Year: 2018).*

(Continued)

*Primary Examiner* — Hosung Chung
(74) *Attorney, Agent, or Firm* — Silvia Salvadori, P.C.; Silvia Salvadori

(57) ABSTRACT

The present invention relates to an electrocatalyst comprising a Ti substrate coated with a 3D Cu nanostructured matrix decorated with a mixture of amorphous $TiO_2$ and nanoparticles of a noble metal, preferably Pt nanoparticles, an electrochemical cell comprising said electrocatalyst and their use for hydrogen production via hydrogen evolution reaction (HER) in basic conditions. The present invention also refers to an in situ process for the preparation of said electrocatalyst and simultaneous production of hydrogen, comprising the steps of: (a) providing an electrochemical cell having a 3-electrode configuration comprising a starting working electrode which comprises a Ti substrate coated (Continued)

with vertically oriented CuO nanoplatelets, the cell further comprising a counter electrode and a reference electrode; (b) adding an aqueous basic electrolyte solution to the cell of step (a), said aqueous basic electrolyte solution comprising a precursor of a noble metal, preferably a Pt precursor; (c) applying a negative potential with respect to the reference electrode to the cell of step b).

The present invention also refers to a process for producing hydrogen which utilizes the electrochemical cell comprising the electrocatalyst according to the invention.

18 Claims, 7 Drawing Sheets

(56) References Cited

U.S. PATENT DOCUMENTS

2011/0207602 A1* 8/2011 Xu ..... H01M 4/90 502/325
2012/0279853 A1* 11/2012 Funakawa ..... C23C 18/08 204/290.14
2020/0370188 A1* 11/2020 Oener ..... C25B 13/08
2021/0310136 A1* 10/2021 Janáky ..... C25B 9/19

OTHER PUBLICATIONS

Du J et al., "A highly active and robust copper-based electrocatalyst toward hydrogen evolution reaction with low overpotential in neutral solution", ACS Applied Materials & Interfaces, vol. 8, No. 44, Oct. 25, 2016, pp. 30205-30211.

Search Report and Written Opinion of PCT/IB2020/055691 of Oct. 23, 2020.

Shinde D.V. et al., "In situ dynamic nanostructuring of the Cu—Ti catalyst-support system promotes hydrogen evolution under alkaline conditions", ACS Applied Materials & Interfaces, vol. 10, No. 35, Aug. 8, 2018, pp. 29583-29592.

* cited by examiner

STABLE HYDROGEN EVOLUTION ELECTROCATALYST BASED ON 3D METAL NANOSTRUCTURES ON A TI SUBSTRATE

This application is a U.S. national stage of PCT/IB2020/055691 filed on 18 Jun. 2020 which claims priority to and the benefit of Italian patent application No. 102019000009753 filed on 21 Jun. 2019, the content of which are incorporated herein by reference in their entireties.

TECHNICAL FIELD

The present invention relates to an electrocatalyst comprising a Ti substrate coated with a 3D Cu nanostructured matrix decorated with a mixture of amorphous $TiO_2$ nanoparticles and nanoparticles of a noble metal, preferably Pt nanoparticles, an electrochemical cell comprising said electrocatalyst and their use for hydrogen production via hydrogen evolution reaction (HER) in basic conditions. The present invention also refers to an in situ process for producing said electrocatalyst and hydrogen and to a process for producing hydrogen, which comprises utilizing said electrochemical cell.

BACKGROUND ART

Hydrogen is considered as a promising fuel for a future sustainable "green" economy, which could replace rapidly depleting fossil fuels. Hydrogen has a high energy density and it is environmentally friendly as the only byproduct of its combustion is water. Nowadays, most of the hydrogen is still produced via the steam methane reforming process, which is, however, a highly energy demanding process. Furthermore, the byproducts of this process include harmful gases such as CO and $CO_2$, making it non-sustainable from an environmental point of view. In this regard, water electrolysis processes performed with the energy obtained from sun or wind, which are "green" and renewable sources, are considered the most promising way to obtain hydrogen.

Nowadays, most of the hydrogen produced by electrolysis comes from electrolytic water splitting and the chloralkali processes, which require efficient and stable hydrogen evolution reaction (HER) electrocatalysts.

In particular, water splitting under alkaline conditions is more attractive, as compared to the same process under acidic conditions, due to the availability of cheap, efficient and stable oxygen evolving catalysts, which only work under alkaline conditions, being unstable in acidic media.

For this reason, various non-noble metals, metal alloys, metal chalcogenides, phosphides, and nitrides, have been developed as efficient catalysts for HER. However, despite the recent huge development of those materials, noble metals, in particular platinum, remain the most active electrocatalysts for HER in alkaline media, even though noble metals and theis alloys are both scarce and expensive, especially when platinum is used.

In addition to the required high level of activity, the long-term stability of the catalysts under operational conditions remains a prerequisite for the large-scale development of water electrolyzers for the hydrogen production.

To date, one of the most active and widespread catalysts in the sector is based on platinum deposited on mesoporous carbon (Pt/C). Although such a catalyst shows a high activity for HER, it suffers from several disadvantages, which include the following facts:

- its activity quickly degrades under operational conditions due to the agglomeration of Pt particles on the carbon support, resulting in a loss of active sites;
- it is not efficient in the production of hydrogen under high current conditions due to the so called "bubble build-up effect", which consists in the difficulty of the formed hydrogen bubbles to escape from the catalyst's surface;
- the Pt/C catalyst is in powder form, thus requiring to be immobilized on the current collector substrate with the help of binders. Usually, such binders are electrically insulating (e.g. Nafion), lowering the overall number of active sites and leading to an inefficient hydrogen evolution. Moreover, the hydrogen bubbles, vigorously evolving during the reaction, may cause the detachment of the catalyst from the substrate, which, in turn, results in a decrease of the final HER activity.

During the last few years, different strategies have been devised in order to solve the issues related to the Pt/C catalyst, notably, in order to avoid the agglomeration of Pt particles during the hydrogen evolution reaction.

One strategy is based on the deposition of Pt on supports other than mesoporous carbon. In this regard, document WO2018/018161 discloses the deposition of Pt:Ag alloys onto a Ag (100) substrate. However, this catalyst exhibited a HER current density of only −5 mA/Cm$^2$ which makes it not suitable for commercial applications. Moreover, no stability data of the catalyst under operational conditions is reported.

Other strategies are instead based on the production of nanostructured materials with catalysts other than Pt or on the combination of nanostructured materials with Pt. In this regard, Shinde et al. (D. V. Shinde et al., "*In situ dynamic nanostructuring of the Cu—Ti Catalyst-Support System Promotes Hydrogen Evolution under Alkaline Conditions*", ACS Appl. Mater. Interfaces 2018, 10, 29583-29592) describe a copper- and titanium-based catalyst with HER activity in basic media, which can be easily prepared using a low-cost solution-based approach, while Raoof et al. (J-B. Raoof et al., "*Fabrication of highly porous Pt coated nanostructured Cu-foam modified copper electrode and its enhanced catalytic ability for hydrogen evolution reaction*", Journal of Hydrogen Energy, 35 (2010), 452-458) describe the preparation of a nanoporous copper foam by electrochemical reduction of copper ions at a copper substrate and galvanic replacement of Cu with Pt.

However, all these materials are still far from an ideal electrocatalyst for HER in basic conditions, in terms of both activity and stability under high current conditions There is therefore a strong need in the field of providing a noble metal based catalyst for hydrogen evolution reaction which is easy to prepare, stable on long term and with improved performance in basic media.

The present invention solves the aforementioned prior art issues by providing an electrocatalyst comprising a Ti substrate coated with a 3D Cu nanostructured matrix decorated with a mixture of amorphous $TiO_2$ nanoparticles and nanoparticles of a noble metal, preferably Pt nanoparticles, with an improved hydrogen evolution activity and long-term stability in basic media, and an in situ process for simultaneously producing said electrocatalyst and hydrogen. The present invention also solves the prior art criticalities by providing an electrochemical cell comprising said electrocatalyst and a process for producing hydrogen which comprises utilizing said electrochemical cell.

SUMMARY OF THE INVENTION

The present invention relates to an electrocatalyst comprising a Ti substrate coated with a 3D Cu nanostructured matrix decorated with a mixture of amorphous $TiO_2$ nanoparticles and nanoparticles of a noble metal. Preferably said noble metal is selected from the group consisting of: platinum (Pt), palladium (Pd), ruthenium (Ru) and gold (Au). More preferably said noble metal is platinum (Pt).

The present invention also relates to an in situ process for the preparation of said electrocatalyst and simultaneous production of hydrogen, comprising the steps of:

(a) providing an electrochemical cell having a 3-electrode configuration comprising a starting working electrode which comprises a Ti substrate coated with vertically oriented CuO nanoplatelets, the cell further comprising a counter electrode and a reference electrode;

(b) adding an aqueous basic electrolyte solution to the cell of step (a), said aqueous basic electrolyte solution comprising a precursor of a noble metal, preferably a Pt precursor;

(c) applying a negative potential with respect to the reference electrode to the cell of step b).

Another object of the present invention is an electrochemical cell and a process for producing hydrogen which comprises utilizing said electrochemical cell. According to the present invention, the electrochemical cell has a 3-electrode configuration comprising the electrocatalyst of the invention as the working electrode, a counter electrode, a reference electrode and an aqueous basic electrolyte solution, optionally comprising a precursor of a noble metal, preferably a Pt precursor.

The present invention also refers to the use of said electrocatalyst and said electrochemical cell for hydrogen production via hydrogen evolution reaction (HER) under basic conditions.

DETAILED DESCRIPTION OF PREFERRED EMBODIMENTS OF THE INVENTION

Figure 1A:
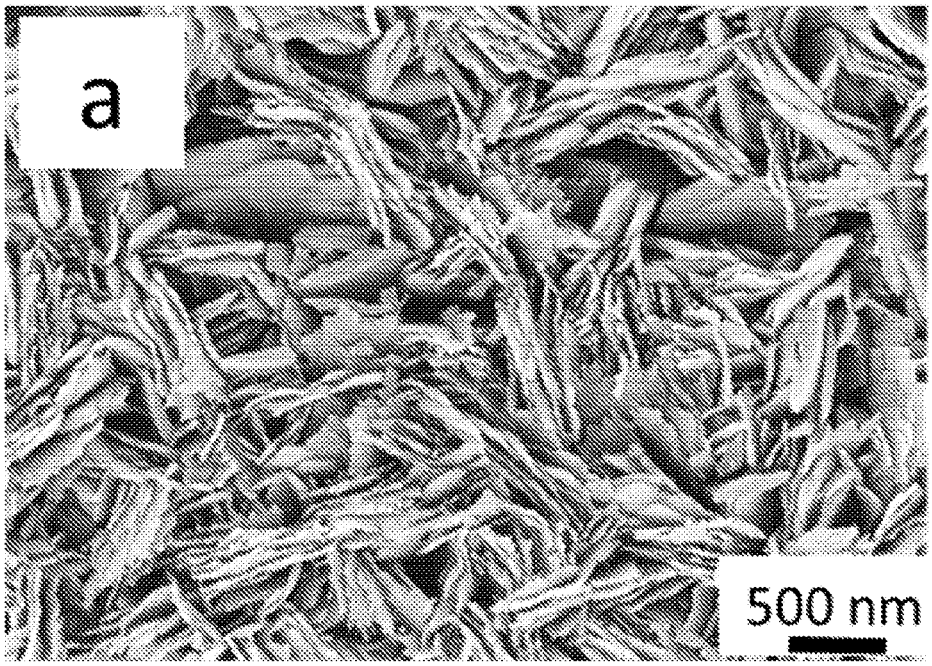
FIG. 1*a* shows a SEM image of CuO nanoplatelets deposited onto the Ti substrate.

For the purposes of the present invention, "nanoparticle of a noble metal" or "noble metal nanoparticle" refers to a nanoparticle of a noble metal, i.e. a metal selected from ruthenium (Ru), rhodium (Rh), palladium (Pd), silver (Ag), osmium (Os), iridium (Ir), platinum (Pt), and gold (Au), in the "0" oxidation state) ($M^0$. For example, "Pt nanoparticle" refers to a nanoparticle of metallic Pt, which means that Pt is present exclusively in the "0" oxidation state ($Pt^0$).

For the purposes of the present invention, "amorphous $TiO_2$" and "amorphous $TiO_2$ nanoparticle" refers to amorphous titanium dioxide (titanium (IV) oxide).

For the purposes of the present invention, the terms "electrocatalyst" and "electrode" are used as equivalent and interchangeable synonyms. An electrocatalyst is a catalyst that participates in an electrochemical reaction (i.e. functioning at electrode surfaces or being the electrode surface itself) by modifying and increasing the rate of the reaction without being consumed in the process.

For the purposes of the present invention, the term "nanoparticle" can be also intended as a synonym of "nanocrystal".

For the purposes of the present invention, the terms "basic condition(s)" and "alkaline condition(s)" are used as equivalent and interchangeable synonyms.

For the purposes of the present invention, the "Ti substrate" can be any substrate consisting of or comprising titanium or its alloys.

The present invention relates to an electrocatalyst comprising a Ti substrate coated with a 3D Cu nanostructured matrix decorated with a mixture of amorphous $TiO_2$ nanoparticles and nanoparticles of a noble metal.

Said nanoparticles of a noble metal decorating the 3D Cu nanostructure matrix have a loading density of between 30 and 60 $\mu g/cm^2$, preferably between 40 and 55 $\mu g/cm^2$.

In other words, this means that the noble metal ($M^0$ content in the electrocatalyst of the invention is of between 30 and 60 $\mu g/cm^2$, preferably between 40 and 55 $\mu g/cm^2$.

According to one embodiment of the invention, the nanoparticles of a noble metal have a mean diameter measured by HRTEM (High-Resolution Transmission Electron Microscopy) technique of between 0.5 and 4 nm, preferably between 1 and 3 nm. Said nanoparticles of a noble metal can be also defined, for the purpose of the present invention, as "ultra-small" nanoparticles.

Preferably said noble metal is selected from the group consisting of: platinum (Pt), palladium (Pd), ruthenium (Ru) and gold (Au).

More preferably said noble metal is platinum (Pt).

According to one embodiment of the invention, the amorphous $TiO_2$ nanoparticles have a mean diameter measured by HRTEM (High-Resolution Transmission Electron Microscopy) technique of between 0.5 and 10 nm, preferably between 1 and 6 nm.

Also, in this case, said amorphous $TiO_2$ nanoparticles can be defined, for the purpose of the present invention as "ultra-small" nanoparticles.

According to one embodiment of the invention, the 3D Cu nanostructured matrix is a 3D network of Cu nanoplatelets interconnected with Cu fiberlike structures. Such a matrix exhibits a structural instability and it can be therefore intended as a "dynamic structure".

In addition, such a three-dimensionally nanostructured matrix has a large surface area, that is electrochemically active, due to the interconnected nature of such Cu nanoplatelets and fiberlike network defining a non-compact structure with infoldings and porosity. Therefore, such 3D Cu nanostructured matrix can be intended, for the purposes of the present invention, as a porous matrix.

According to one embodiment of the invention, the 3D Cu nanostructured matrix forms a layer on the Ti substrate, said layer having a thickness of between 500 and 1000 nm, preferably between 600 and 900 nm.

Advantageously, the simultaneous presence of a mixture of amorphous $TiO_2$ nanoparticles and nanoparticles of a noble metal decorating the 3D Cu nanostructured matrix of the electrocatalyst according to the present invention, allows to have a high hydrogen evolution efficiency. Without wishing to be bound to any specific theory, the high catalytic activity of the electrocatalyst of the present invention can be attributed to the following factors and their synergistic combination:

- the high catalytic activity of noble metal nanoparticles towards the hydrogen evolution reaction (HER);
- the co-presence of nanostructured Cu and amorphous $TiO_2$ nanoparticles decorating the Cu nanostructured matrix, which guarantee an effective charge transfer, thus minimizing the charge transfer resistance;
- the presence of a strong link between the noble metal nanoparticles and the Cu nanostructured matrix and the dynamic structure of the matrix itself, which prevent the aggregation of the noble metal nanoparticles;
- the presence of a strong link between the Cu matrix and the Ti substrate, which advantageously avoids any delamination between the 3D Cu nanostructured matrix and the Ti substrate, even with no use of binders;
- the nanostructured nature of the Cu matrix as defined above, which allows for a large electrochemically active surface area (ECSA) and, thanks to its porous nature and to the large number of active sites available, facilitates the in-diffusion of the electrolyte ions and the out diffusion of the formed hydrogen gas ($H_{2(g)}$).

Thanks to the combination of these factors, the electrocatalyst of the present invention can sustain high current densities at high applied potentials with an excellent stability under HER operational conditions.

Preferably the electrocatalyst of the invention does not undergo degradation in such conditions and it can be used several times without the need to be regenerated.

In particular, the electrocatalyst of the invention advantageously maintains its original activity for up to 24 hours of continuous operation at an overpotential comprised between −100 and −300 mV and current density comprised between −30 and −300 mA/cm$^2$.

Preferably, the electrocatalyst of the invention advantageously maintains 100% of its original activity after 24 hours of continuous operation, at a −200 mV overpotential and −142 mA/cm$^2$ current density.

Another object of the present invention is an in situ process for the preparation of the above-described electrocatalyst and simultaneous production of hydrogen. Said in situ process comprises the steps of:

(a) providing an electrochemical cell having a 3-electrode configuration comprising a starting working electrode which comprises a Ti substrate coated with vertically oriented CuO nanoplatelets, the cell further comprising a counter electrode and a reference electrode;

(b) adding an aqueous basic electrolyte solution to the cell of step (a), said aqueous basic electrolyte solution comprising a precursor of a noble metal;

(c) applying a negative potential with respect to the reference electrode to the cell of step b).

According to one embodiment of the invention the CuO nanoplatelets of step (a) are deposited on the Ti substrate by a low-temperature solution deposition process comprising:

(a.I) providing an aqueous solution comprising copper salt and ammonia;

(a.II) immersing the Ti substrate into said solution and heating to a temperature comprised between 60 and 90° C., preferably between 75 and 85° C., to form copper-ammine complexes, which decompose and lead to a heterogeneous nucleation of vertically oriented CuO nanoplatelets on the substrate.

Without whishing to be bound to any specific theory, the formation of CuO nanoplatelets is assumed to proceed through the initial nucleation of metastable $Cu(OH)_2$ layered nanostructures, which are immediately converted into more stable CuO nanoplatelets.

The aqueous basic electrolyte solution of step (b) is preferably in a concentration of between 0.1 M and 1 M.

Preferably said aqueous basic electrolyte solution is selected from the group consisting of NaOH, KOH and LiOH aqueous solutions and combination thereof. More preferably the aqueous basic electrolyte solution is a NaOH aqueous solution. Even more preferably, the aqueous basic electrolyte solution is a 1 M NaOH aqueous solution.

Preferably the precursor of a noble metal of step (b) is in a concentration of between 0.2 and 10 μg/ml, preferably between 0.4 and 8 μg/ml.

Preferably said noble metal is selected from the group consisting of: platinum (Pt), palladium (Pd), ruthenium (Ru) and gold (Au). More preferably said noble metal is platinum (Pt).

Preferably said precursor of a noble metal is selected from the group consisting of complex salts of said noble metal which are soluble in the aqueous basic electrolyte solution of step (b).

In a particularly preferred embodiment of the present invention, said precursor of a noble metal is a Pt precursor, preferably selected from a complex salt of platinum, more preferably selected from $K_2PtCl_6$, $Na_2PtCl_6$, $H_2PtCl_6$, $(NH_4)_2$ $PtCl_6$ and combination thereof. Even more preferably, the Pt precursor is $Na_2PtCl_6$.

In another embodiment of the present invention, said precursor of a noble metal is a Pd precursor, preferably selected from a complex salt of palladium, more preferably selected from $(NH_4)_2PdCl_6$, $Na_2PdCl_6$, $K_2PdCl_6$ and combination thereof.

In another embodiment of the present invention, said precursor of a noble metal is a Ru precursor, preferably selected from a complex salt of ruthenium, more preferably selected from $K_2RuCl_6$, $(NH_4)_2RuCl_6$ and combination thereof.

In another embodiment of the present invention, said precursor of a noble metal is an Au precursor, preferably selected from a complex salt of gold, more preferably selected from $NaAuCl_4*2H_2O$, $KAuCl_4*2H_2O$, $NH_4AuCl_4*H_2O$ and combination thereof.

Preferably the reference electrode is selected from the group consisting of: aqueous reference electrodes, such as saturated calomel electrode, silver/silver chloride electrode, silver/silver sulfate electrode, mercury/mercurous sulfate electrode and mercury/mercury oxide electrodes.

Preferably, the reference electrode is an aqueous reference electrode, more preferably a double-junction Ag/AgCl (3.8 M KCl) reference electrode.

According to a preferred embodiment of the invention, the reference electrode is a double junction Ag/AgCl (3.8 M KCl) and the negative potential applied in step (c) is of between −1.1 and −1.5 V, preferably of between −1.2 and −1.4 V against the Ag/AgCl (3.8 M KCl) reference electrode.

However, it is clear that a skilled man in the art would be able to use any type of reference electrode suitable and available for this type of process and adapt the potential to be applied accordingly.

The counter electrode is selected from electrically conducting materials such as nickel, titanium, gold, graphite rod and platinum, preferably a Pt wire.

Preferably, said negative potential applied in step (c) is a constant potential.

Advantageously, such an in situ process leads to the simultaneous production of an electrode comprising a Ti substrate coated with a 3D Cu nanostructured matrix decorated with a mixture of amorphous $TiO_2$ nanoparticles and noble metal nanoparticles (i.e. the electrocatalyst according to the present invention as described above) and hydrogen.

Without wishing to be bound to any specific theory, the in situ process according to the present invention results in the dynamic morphological and chemical modification of the starting working electrode of step (a) which leads to the production of the electrocatalyst of the invention and hydrogen, thanks to the superimposition of different electrochemical process simultaneously occurring once the negative potential is applied:

- the CuO nanoplatelets on the Ti substrate are locally reduced and undergo a dissolution-redeposition process (i.e. dynamic restructuring process) which leads to the formation of a 3D Cu nanostructured matrix, said matrix being porous, "dynamic" and in the form of a network of Cu nanoplatelets interconnected with Cu fiberlike structures;
- the Ti substrate undergoes etching with the consequent formation of amorphous $TiO_2$ nanoparticles which nucleates on the Cu porous matrix;
- at the same time, part of the applied potential of step (c) leads to the reduction of the noble metal ions present in the aqueous electrolyte basic solution of step (b) in their oxidized state ($M^{n+}$) to $M^0$, which deposits on the surface of the Cu porous matrix and nucleates on it, thus forming noble metal nanoparticles; for example in the case of a particularly preferred embodiment of the invention, said part of the applied potential of step (c) leads to the reduction of the $Pt^{4+}$ ions present in the aqueous electrolyte basic solution of step (b) to $Pt^0$, which deposit on the surface of the Cu porous matrix and nucleates on it, thus forming Pt nanoparticles;
- the remaining part of the applied potential is consumed by the hydrogen evolution reaction.

Preferably, the amount of the electrodeposited noble metal nanoparticles decorating the Cu matrix increases during the first period of application of the negative potential, preferably up to 15 hours from the start of the application, and then it remains constant.

Preferably the electrodeposited noble metal nanoparticles have a final loading density of between 30 and 60 μg/cm$^2$, preferably between 40 and 55 μg/cm$^2$. In other words, this means that the final noble metal content in the electrocatalyst of the invention is of between 30 and 60 μg/cm$^2$, preferably between 40 and 55 μg/cm$^2$.

Advantageously, the final noble metal content can be adjusted by varying the amount of precursor of the noble metal present in the electrolyte solution of step (b) and/or the applied potential of step (c).

The here described electrocatalyst and the relating in situ process for its production and simultaneous hydrogen evolution, find application in the field of alkaline electrolyzers with many advantages. In particular, the direct in situ formation of the electrocatalyst is easily feasible and avoids the use of expensive and tedious ex situ techniques, thus reducing the cost of the catalyst itself.

Without wishing to be bound to any specific theory, it can be envisaged that such an in situ process leads to the production of the electrocatalyst of the invention with all the above-described features and to the simultaneous hydrogen production.

In particular, the process advantageously minimizes the resistance between the Ti substrate (which functions as the current collector) and the Pt nanoparticles (which have the actual catalytic activity), and, at the same time, results in a strong binding between such nanoparticles, the Cu matrix and such substrate.

Furthermore, being the electrodeposited noble metal nanoparticles solidly anchored to the Cu matrix, no aggregation of said noble metal nanoparticles occurs even after prolonged use. This unprecedented phenomenon results in the overall stability of the electrocatalyst even after a vigorous hydrogen evolution achieved under high current conditions, which are typically employed in commercial alkaline electrolyzers. As already mentioned above, the porous nature of the Cu matrix maximizes the number of active sites accessible for the hydrogen evolution reaction and, at the same time, allows the formed hydrogen bubbles to easily escape, therefore allowing the electrocatalyst of the present invention to sustain, during the described in situ process, high current densities at high applied potentials with an excellent stability under HER operational conditions for up to 24 hours of continuous operation at a overpotential comprised between −100 and −300 mV and current density comprised between −30 and −300 mA/cm$^2$.

Preferably the in situ process for the production of the electrocatalyst of the invention and hydrogen, allows to obtain a stable electrocatalyst which does not undergo degradation in such conditions and can be used in the hydrogen evolution reaction several times without the need to be regenerated.

Another object of the present invention concerns an electrochemical cell having a 3-electrode configuration comprising the above-described electrocatalyst according to the present invention as the working electrode, a counter electrode, a reference electrode and an aqueous basic electrolyte solution.

Such an electrochemical cell can therefore be obtained by inserting the electrocatalyst of the present invention in a 3-electrode configuration cell further comprising a counter electrode and a reference electrode and adding an aqueous basic electrolyte solution to said cell.

According to one embodiment of the invention, said electrochemical cell comprises an aqueous basic electrolyte solution further comprising a precursor of a noble metal as described above.

Preferably, the reference electrode is selected from the group consisting of: aqueous reference electrodes, such as saturated calomel electrode, silver/silver chloride electrode, silver/silver sulfate electrode, mercury/mercurous sulfate electrode and mercury/mercury oxide electrodes.

Preferably the reference electrode is an aqueous reference electrode, more preferably a double-junction Ag/AgCl (3.8 M KCl) reference electrode.

The counter electrode is selected from electrically conducting materials such as nickel, titanium, gold, graphite rod and platinum, preferably a Pt wire.

Preferably said aqueous basic electrolyte solution and the optional precursor of a noble metal are as described above.

The present invention also relates to a process for producing hydrogen comprising: providing an electrochemical cell; and applying a negative potential with respect to the reference electrode to the cell.

According to a preferred embodiment of the invention, the reference electrode is a double junction Ag/AgCl (3.8 M KCl) and said negative potential applied is of between −1.1 and −1.5 V, preferably of between −1.2 and −1.4 V against the Ag/AgCl (3.8 M KCl) reference electrode.

Preferably, said negative potential applied is a constant potential.

Since said electrochemical cell comprises the electrocatalyst according to the present invention, during said process for producing hydrogen, said electrocatalyst is able to sustain high current densities at high applied potentials with an excellent stability under HER operational conditions, in particular for up to 24 hours of continuous operation at a overpotential comprised between −100 and −300 mV and current density comprised between −30 and −300 mA/cm$^2$.

Preferably, during said process for the production of hydrogen, the electrocatalyst comprised in the electrochemical cell of the invention does not undergo degradation in the operative HER conditions and can be used in the hydrogen evolution reaction several times without the need to be regenerated.

Finally, the present invention relates to the use of the electrocatalyst as described above for hydrogen production via hydrogen evolution reaction under basic condition.

The present invention also relates to the use of the above-described electrochemical cell comprising the electrocatalyst of the invention, for hydrogen production via hydrogen evolution reaction under basic condition.

EXAMPLES

Example 0

Structural Characterization and Elemental Analyses

SEM—Scanning Electron Microscopy

SEM analyses were performed on electrodes coated with a 10 nm gold layer using a FEI NanoLab 600 dual-beam system.

HRTEM—High-Resolution Transmission Electron Microscopy

HRTEM micrographs were acquired using a JEOL JEM-2200 FS, operating at 200 KV. The samples were prepared by scratching off the materials from the electrodes (i.e. the electrocatalysts) and dispersing them in ethanol. The catalyst dispersions were dropped onto 400 mesh copper grids (coated with ultrathin carbon/holey carbon) for imaging. The microscope was equipped with a Ω-type in-column image filter and a CEOS spherical aberration corrector for the objective lens. This enabled a spatial resolution of 0.9 ⊢.

XPS—X-Ray Photoelectron Spectroscopy

XPS analyses were performed on a Kratos Axis Ultra DLD spectrometer, using a monochromatic Al Kα source, operated at 20 mA and 15 kV. Low-resolution survey scans were acquired at an analyzer pass energy of 160 eV, whereas high-resolution scans were acquired in 0.1 eV steps at a constant pass energy of 20 eV, over the energy regions typical of the main XPS peaks for Cu, Pt and Ti. A takeoff angle (D) of 0° with respect to the surface normal was used to detect photoelectrons. The pressure in the analysis chamber was always kept below $6\times10^{-9}$ Torr during the analysis. The data were processed using Casa XPS version 2.3.17. The C 1 s peak at 284.8 eV was used as an internal reference for binding energy scale.

ICP-OES—Inductively Coupled Plasma Optical Emission Spectroscopy

The samples for ICP-OES analysis were prepared by scratching off the catalyst material from Ti substrate and dissolving in aqua regia. The solutions were then diluted to 25 ml using deionized water. The analysis was performed on an iCAP 6300 DUO ICP-OES spectrometer (ThermoScientific).

EDS—Energy Dispersive X-Ray Spectroscopy

EDS was measured on a JEOL JEM-2200FS microscope, operating at 200 KV.

Electrochemical Measurements

The setup for electrochemical measurements consisted of an electrochemical cell containing Pt wire (counter electrode), the CuO nanoplates grown on a Ti substrate of 0.25 cm$^2$ area (working electrode), and a double-junction Ag/AgCl (3.8 M KCl) (reference electrode). All measurements were performed on a IVIUM Compactstat potentiostat. Linear sweep voltammograms (LSVs) were measured by scanning the potential between −0.8 and −1.3 V vs Ag/AgCl (3.8 M KCl) electrode. The chronoamperometry (CA) measurements were performed by applying various constant applied potentials. Impedance analysis was performed at a constant potential of −0.2 V vs RHE (Reversible Hydrogen Electrode). The spectra were recorded with a potential amplitude of 5 mV in a frequency range of 0.1 MHz to 0.1 Hz. All the potentials are reported versus the reversible hydrogen electrode scale (RHE), unless otherwise noted. The potentials were converted using the following formula $E_{RHE}=E_{obs}+E_{Ag/AgCl}+(0.0591\times pH)$, where $E_{Ag/AgCl}$ has a value of 0.199 vs SHE (Standard Hydrogen Electrode) and $E_{obs}$ refers to the actual observed potential.

Example 1

In Situ Preparation of the Electrocatalyst

As a first step, CuO nanoplatelets were deposited on a Ti substrate by means of a low temperature wet chemical approach as described by Shinde et al. (D. V. Shinde et al. "*In situ dynamic nanostructuring of the Cu—Ti Catalyst-Support System Promotes Hydrogen Evolution under Alkaline Conditions*", ACS Appl. Mater. Interfaces 2018, 10, 29583-29592), which relies on the use of copper-ammine complexes in aqueous solutions.

1.5 mmol of copper chloride dihydrate was dissolved in 30 ml of deionized water in a 40 ml glass vial to form a faint blue solution. After the addition of 1.5 ml of ammonia, the solution became deep blue, indicating the formation of a copper-ammine complex. A precleaned Ti substrate (i.e. a Ti plate substrate previously washed by ultrasonication in a solution of 2-propanol and acetone 1:1 by volume and dried in a stream of air) was then vertically inserted in the vial, and the whole system was heated up to 80° C. for 2 hours on a hotplate. After completing the reaction, the black CuO-coated Ti substrate was removed, washed with deionized water, and dried with a stream of air.

The in situ decomposition of the complexes, which leads to the formation of CuO nanoplatelets on Ti substrates, is confirmed by SEM images as reported in FIG. 1*a* showing that the CuO nanoplatelets grow perpendicular to the Ti substrate.

The CuO—Ti support thus obtained was then used as a working electrode for HER in a 3-electrode electrochemical cell (further comprising a Pt wire as a counter electrode and a double-junction Ag/AgCl (3.8 M KCl) as reference electrode) using a 1 M NaOH solution in water as the electrolyte solution. Then, a sodium hexachloroplatinate solution (1 mg/ml $Na_2PtCl_6$ solution in water) was added (at different increasing concentrations of 25, 50 or 100 μL for different samples) to the electrolyte solution. A potential of −1.2 V with respect to the Ag/AgCl (3.8 M KCl) electrode was applied to the cell in order to start the electrodeposition of Pt. In this way, electrodes having different Pt loadings were obtained and investigated.

Of particular importance, no precipitate was observed in the electrolyte bath upon the addition of $Na_2PtCl_6$, indicating that the complex salt of Pt is soluble in the 1 M NaOH solution.

Example 2

Figure 2A:
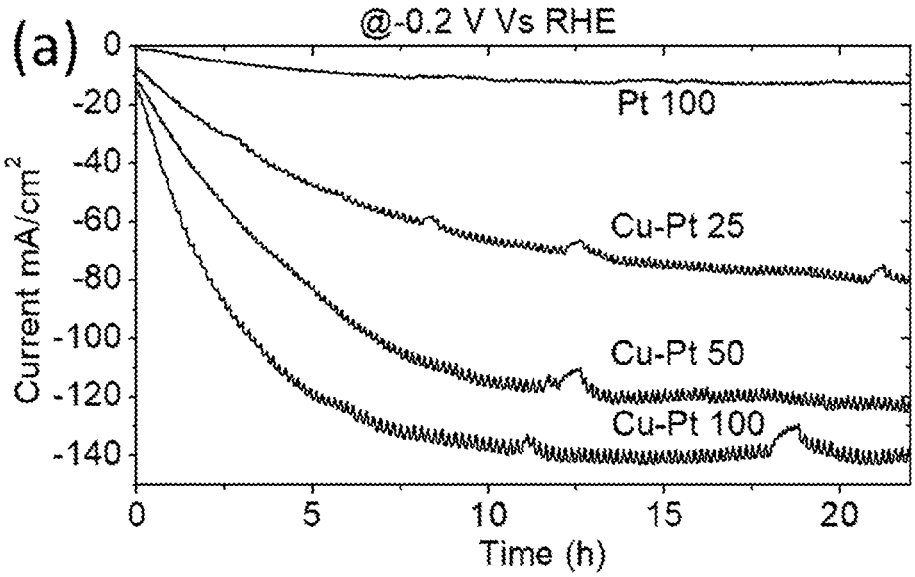
FIG. 2*a* shows the evolution of the current as a function of the CA time at an applied potential of −0.2 V vs RHE of the electrocatalyst obtained by employing different amount (25, 50 and 100 μL) of a 1 mg/ml $Na_2PtCl_6$ solution. Pt-100 refers to the electrocatalyst where Pt is directly deposited on the Ti substrate.

Chronoamperometry (CA) and Inductively Coupled Plasma Optical Emission Spectroscopy (ICP-OES) Characterization FIG. 2*a* shows the chronoamperometry (CA) plots of Cu—Ti electrodes immersed in 30 ml of 1 M NaOH electrolyte solution upon the addition of different amounts of 1 mg/ml $Na_2PtCl_6$ solution in water as described in Example 1. In each plot (Cu—Pt 25, Cu—Pt 50 and Cu—Pt 100), the current increases during the first 15 hours eventually stabilizing afterward, without any further increase. Interestingly, the increase in the current is followed by a vigorous hydrogen evolution from each electrode.

Figure 2B:
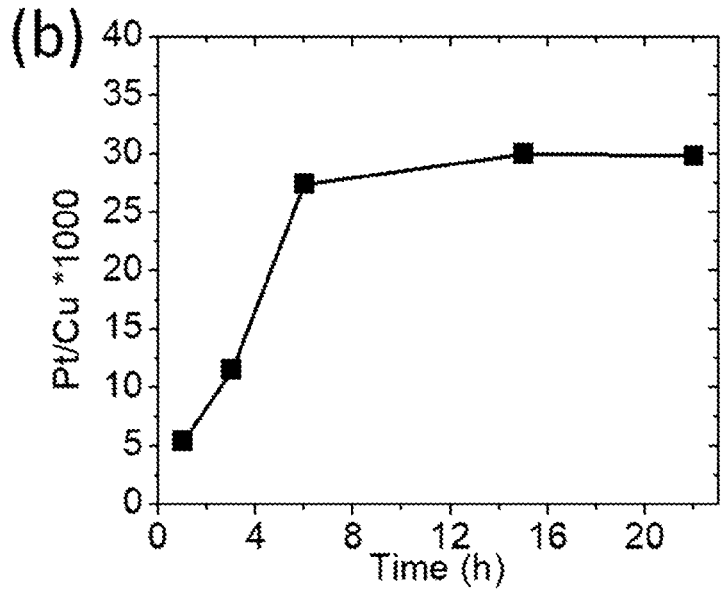
FIG. 2*b* shows the weight ratio of Pt/Cu (measured by ICP) in the Cu—Pt/Ti 100 electrocatalyst as a function of deposition time.

For a better comparison, an electrode where Pt was directly deposited on the Ti substrate, was also produced and tested (Pt-100). It is interesting to notice, that in this case the increase of the HER current is very low, indicating an inefficient hydrogen evolution. During the electrochemical measurements, the composition of the electrodes (i.e. the amount of Pt and Cu) at different time intervals were measured by inductively coupled plasma optical emission spectroscopy (ICP-OES). FIG. 2*b* shows the variation of the Pt/Cu ratio as a function of the CA time in the case of the sample obtained using 100 μL of the $Na_2PtCl_6$ solution (Cu—Pt/Ti 100). Considering that the overall amount of Cu remains constant (there is no etching of the Cu matrix of the electrode), the measured Pt/Cu ratios reflect the change in the amount of Pt as a function of electrodeposition time. It is clear that the amount of Pt increases during the first 15 hours and then it remains constant. The Pt deposition rate, calculated from the ICP results, is about 3.46 μg/h. These results indicate that part of the applied potential leads to the reduction of $Pt^{4+}$ ions to $Pt^0$, which deposits onto the Cu layer, while the remaining current is consumed by the hydrogen evolution reaction. Therefore, the increase of the cathodic current in the first 15 h of CA plots can be attributed to the contextual growth of Pt nanocrystals.

For subsequent Examples, only the electrode obtained using 100 μL of the $Na_2PtCl_6$ solution (Cu—Pt/Ti100) which have shown the best characteristic in terms of hydrogen evolution, have been employed and further characterized.

Example 3

Figure 1B:
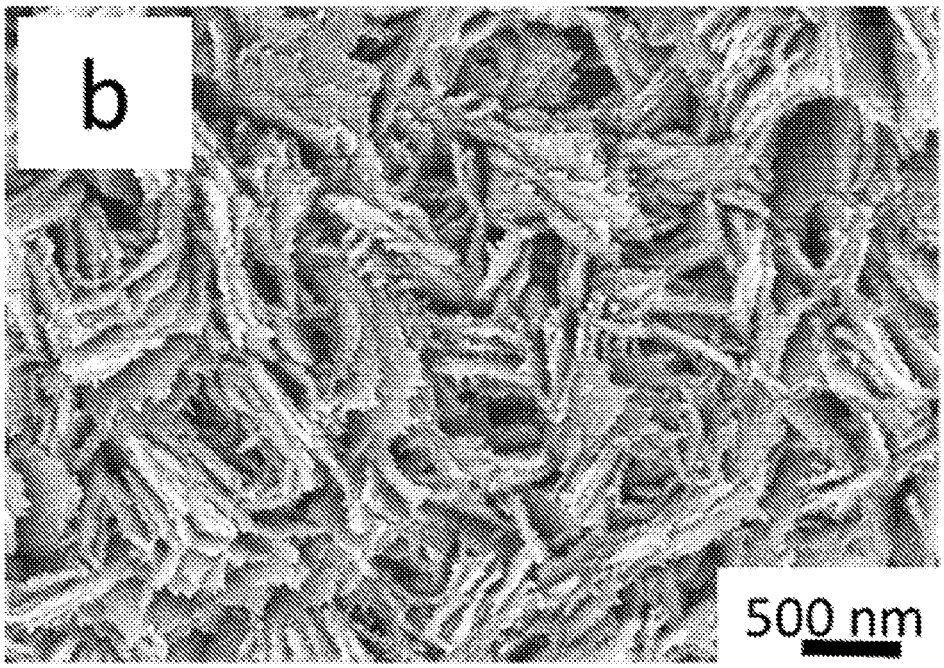
FIG. 1*b* shows a SEM image of the in situ formed Cu—Pt/Ti electrocatalyst after deposition of Pt nanoparticles for 24 hours.

Scanning Electron Microscopy (SEM), High-Resolution Transmission Electron Microscopy (HRTEM) and Energy Dispersive X-Ray Spectroscopy After the complete deposition of Pt, the electrode (Cu—Pt/Ti 100) was removed from the electrolytic bath for further characterizations. FIG. 1*b* shows a SEM image of the Cu—Pt/Ti 100 electrode after 22 hours of CA. It can be seen that the surface of the CuO nanoplatelets becomes rougher if compared to the pristine CuO nanoplatelets (see FIG. 1*a*). As already mentioned in the text of the detailed description, this is mainly due to the following different factors:

- the reduction of CuO to Cu causes a shrinkage of the material, which is due to the loss of oxygen anions and to the fact that the lattice parameters of Cu are smaller than those of CuO;
- the formation of amorphous $TiO_2$ and Pt nanocrystals on the Cu surface;
- the nanostructuring of Cu which originates from a dissolution-redeposition process under HER conditions.

Figure 1C:
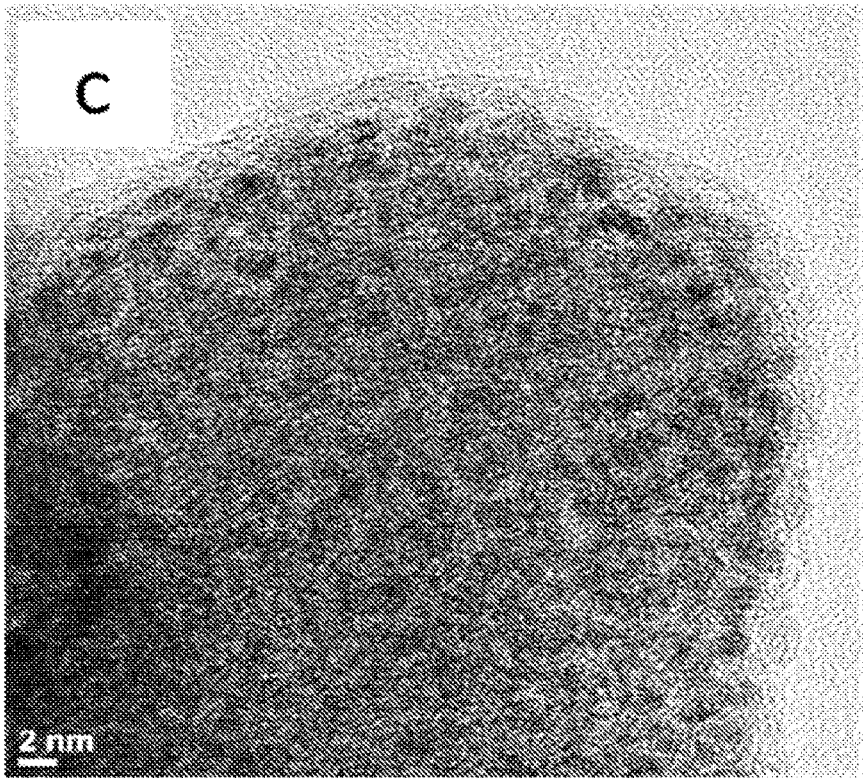
FIGS. 1*c* and 1*d* show HRTEM images of the in situ formed Cu—Pt/Ti electrocatalyst after deposition of Pt nanoparticles for 24 hours.
Figure 1D:
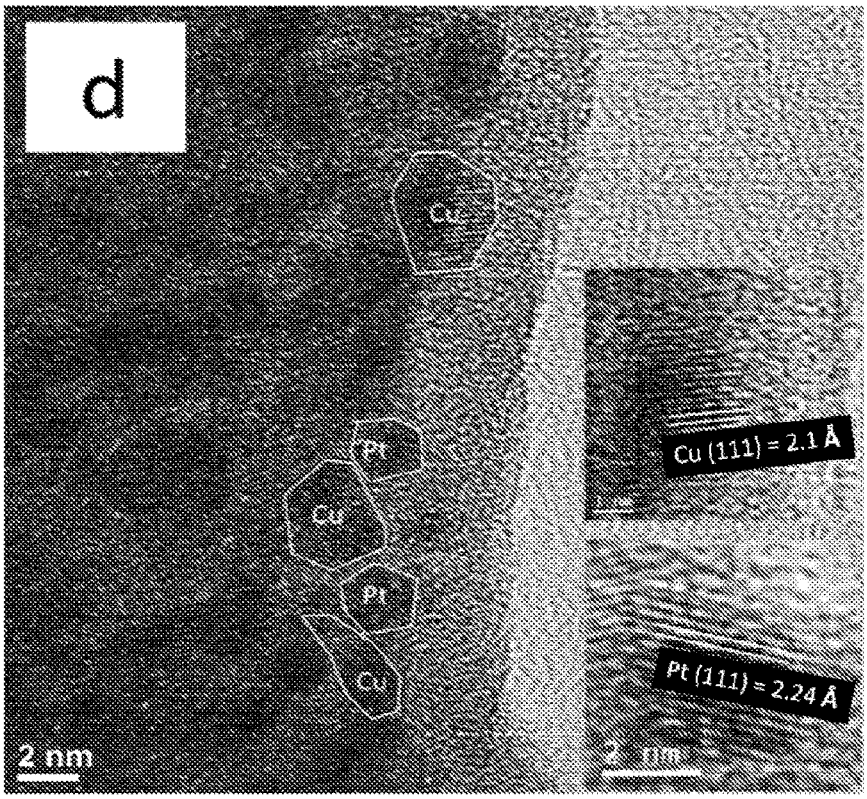
Figure 1E:
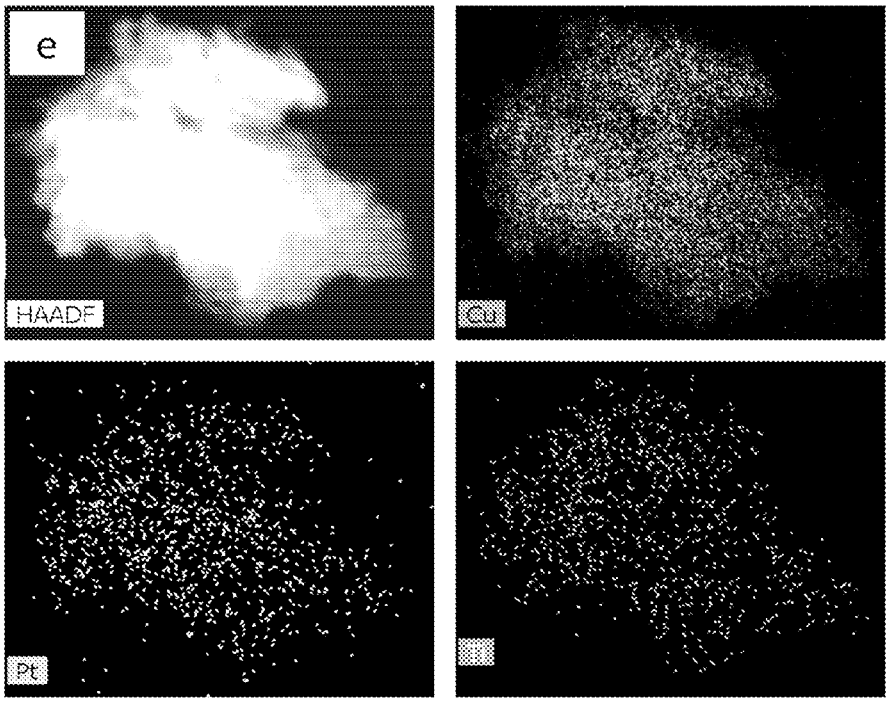
FIG. 1*e* shows a HAADF image and an EDS mapping of the Cu—Pt/Ti 100 electrocatalyst.

More in details, when applying a constant negative potential to an electrode made of CuO nanoplatelets deposited on Ti substrate, a dissolution-redeposition process occurs. CuO is first reduced to Cu; then a kinetic equilibrium establishes between the oxidation of $Cu^0$ to Cu—OH species (driven by the strong alkaline environment), the solubilization of Cu—OH species into the electrolyte and the reduction of such species to form $Cu^0$ (operated by the negative potential) which deposits as Cu nanocrystals on the surface of the electrode. At the same time, part of the Ti substrate is oxidized and forms amorphous $TiO_2$ nanoparticles in the Cu matrix. In addition to the aforementioned processes, the presence of a Pt salt inside the electrolyte solution leads to the concomitant electrodeposition of $Pt^0$ on the top of the Cu matrix, which nucleates into Pt nanoparticles. Indeed, the high-resolution transmission electron microscope (HRTEM) characterization of the final electrode (FIGS. 1*c* and 1*d*) reveals that the electrode is composed of ultra-small metallic Cu and Pt nanoparticles. Furthermore, energy dispersive X-ray spectroscopy (EDS) of the electrode (FIG. 3*e*) reveals the presence of both Cu, Pt elements, along with a small amount of Ti.

Example 4

X-Ray Photoelectron Spectroscopy (XPS) Analysis

Figure 3:
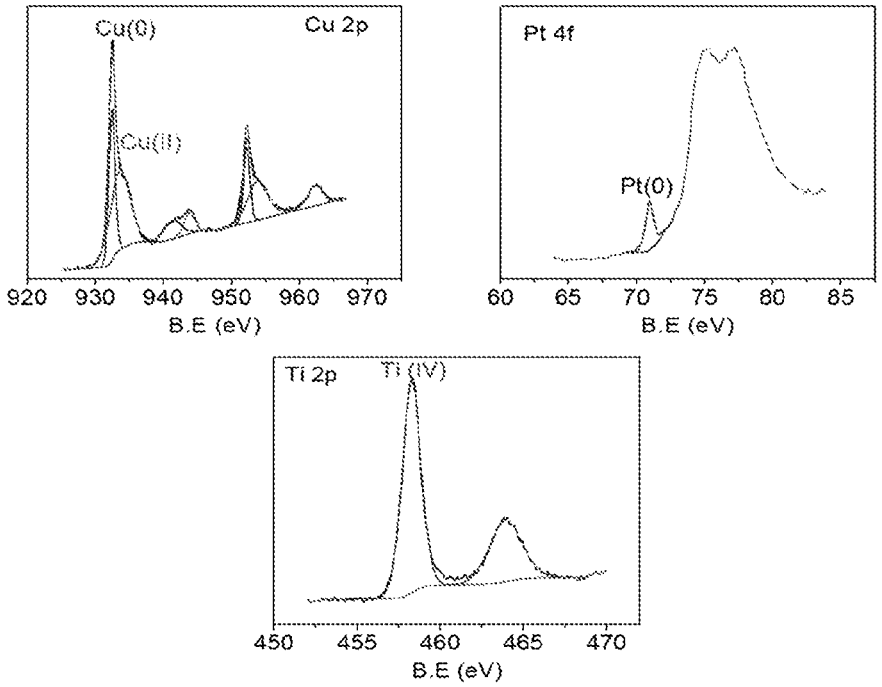
FIG. 3 shows the XPS analysis of the Cu—Pt/Ti 100 electrocatalyst obtained after the in situ deposition of Pt nanoparticles for 24 hours.

In order to determine the oxidation state of Cu, Pt and Ti elements, the electrode (Cu—Pt/Ti 100) has been further characterized by X-ray photoelectron spectroscopy (XPS) analysis. FIG. 3 reports the XPS spectra of the electrode in the Cu 2p, Pt 4f and Ti 2p regions. The Cu 2p region evidences the presence of Cu(0) and Cu(II) oxidation states. The presence of Cu(0) is obvious, while that of Cu(II) is due to the surface oxidation of the electrode, which occurs, most likely, after the removal of the negative potential and the exposure of the electrode to the air. Pt is present exclusively in the 0 oxidation state, indicating that the Pt is present on the electrode in the form of metallic Pt nanoparticles. Ti is predominantly in +4 oxidation state due to presence of amorphous $TiO_2$ nanoparticles.

Inductively coupled plasma spectroscopy (ICP) analysis showed the Pt content of the final Cu—Pt/Ti electrode to be 51 μg/cm$^2$. Overall, these results indicate that when a constant potential is applied to the Cu—Ti electrode, part of the applied current results in the reduction of Pt(IV) ions to $Pt^0$, which deposits onto the Cu layer in the form of Pt nanocrystals, while the remaining current is consumed by the hydrogen evolution reaction. This is consistent also with the increase in the cathodic current registered in the first 15 h of CA plots, which can be attributed to the contextual electrodeposition of metallic Pt nanocrystals (which increase the activity of the electrode, and thus the cathodic current).

Example 5

Comparative Example

The HER activity of the electrode according to the present invention (Cu—Pt/Ti 100) has been measured and compared with that of a common Pt/C catalyst by keeping fixed the setup and the type of the electrolyte.

Figure 4:
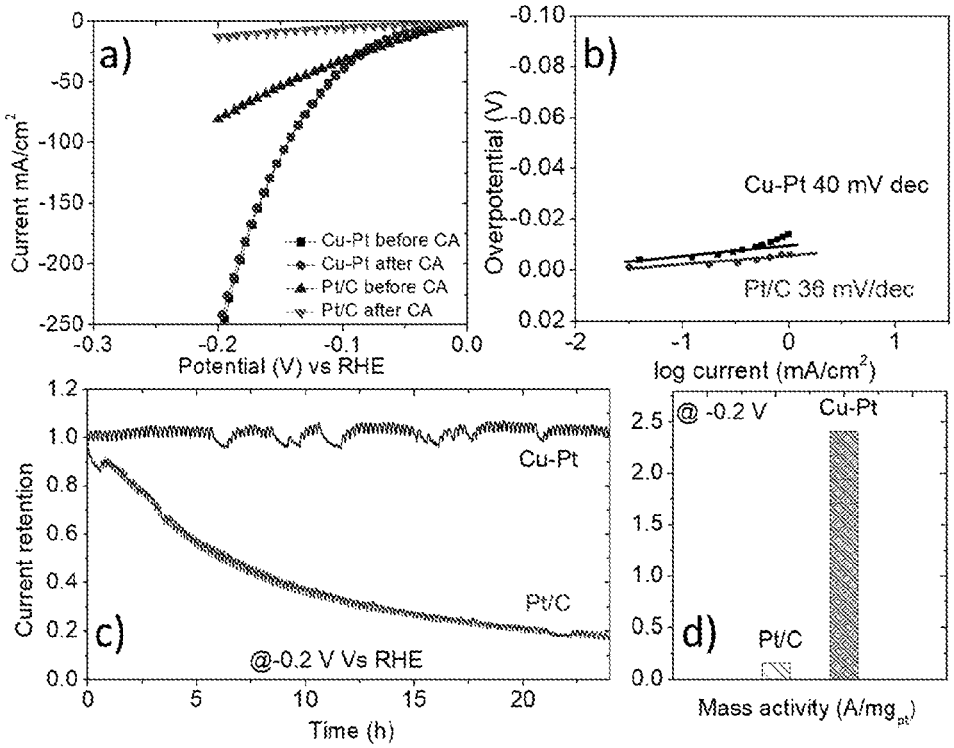
FIG. 4*a* shows the LSVs of "before CA" and "after CA" tests of Cu—Pt/Ti 100 and Pt/C electrocatalysts.
FIGS. 4*b*, 4*c* and 4*d* respectively show Tafel plots, CA plots and mass activities of the Cu—Pt/Ti 100 and Pt/C electrocatalysts measured after 24 hours of CA.
Figure 5A:
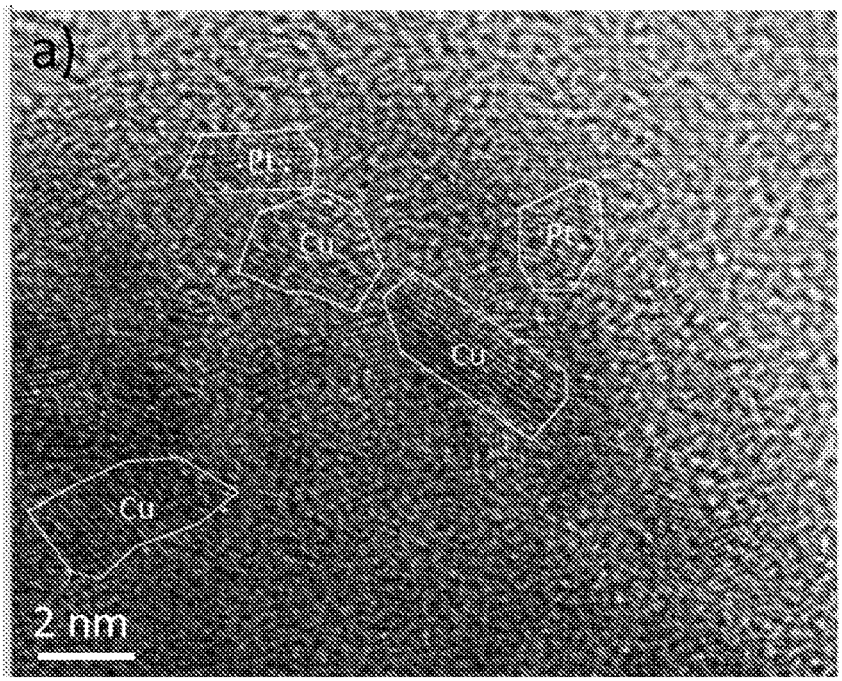
FIG. 5*a* shows a HRTEM image of the Cu—Pt/Ti 100 electrocatalyst after continuous hydrogen evolution for 24 hours.
Figure 5B:
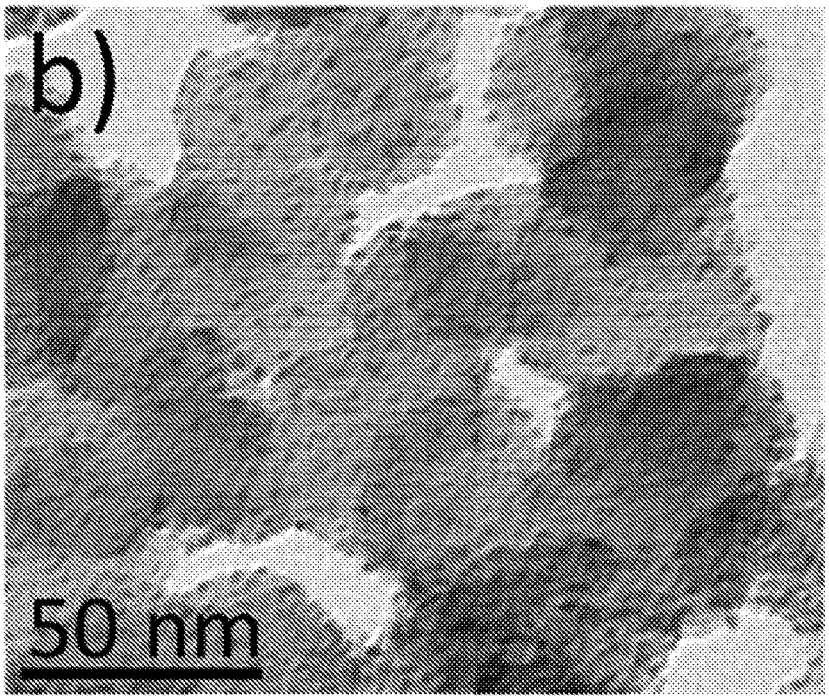
FIGS. 5*b* and 5*c* respectively show TEM images of the Pt/C electrocatalyst before and after hydrogen evolution for 24 hours.
Figure 5C:
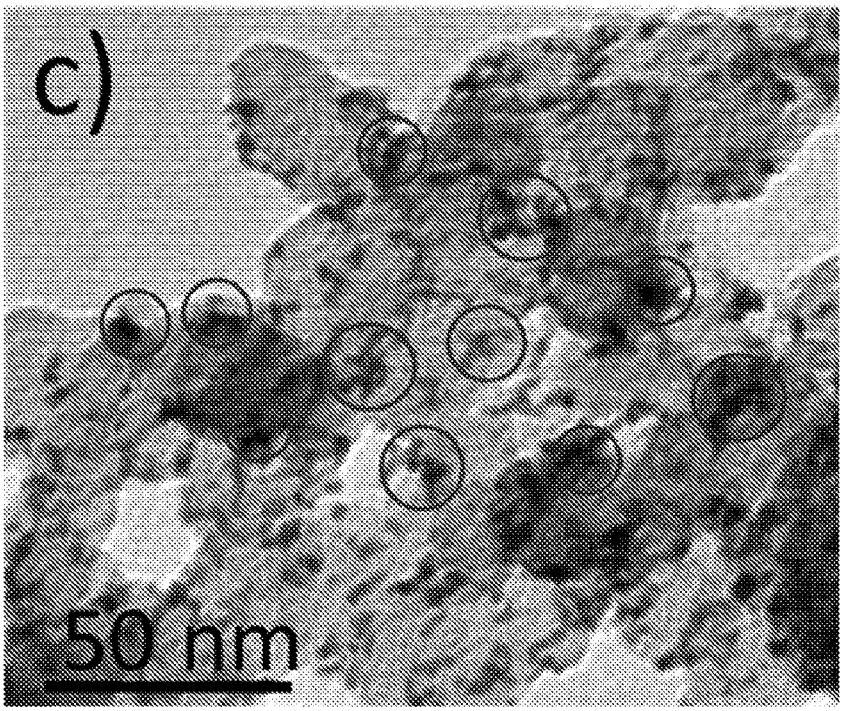

All the measurements were performed in a 1 M NaOH electrolyte solution in water. For the Cu—Pt/Ti 100 electrocatalyst, the same electrolyte bath comprising Pt used for the in situ fabrication of the electrocatalyst itself was used. FIG. 4*a* shows linear sweep voltammograms (LSVs) of Cu—Pt/Ti and Pt/C electrodes measured at a sweep rate of 10 mV/s. The Pt/C electrode shows an early rise of the HER current, however, the Cu—Pt electrode current rises rapidly and outperforms the Pt/C catalyst at higher overpotentials. This can be attributed to the highly porous nature of the Cu—Pt/Ti electrode, which enables the electrolyte to easily access active sites, the formed hydrogen bubbles to readily escape from the catalyst's surface. On the other hand, in FIG. 4*a* it is also possible to appreciate that the Pt/C catalyst suffers from the bubble build-up effect, which is responsible for its decreased HER current at high overpotentials. The HER kinetics of the electrodes is evaluated by plotting Tafel plots (FIG. 4*b*). The Cu—Pt/Ti electrode (40 mV/dec) and the Pt/C electrode (36 mV/dec) exhibits similar HER kinetics. It is worthy to note that similar loading of Pt in both Cu—Pt catalyst and the benchmark Pt/C catalyst (50 μg/cm$^2$) have been used to avoid the influence of mass loading on HER kinetics. Although initially the Pt/C exhibits a high activity for HER (even higher than that of the Cu—Pt/Ti catalyst), its activity rapidly decreases. Furthermore, both Cu—Pt and Pt/C electrodes have been subjected to CA tests under a constant applied potential of −0.2 V. Vigorous hydrogen evolution is observed initially on both the electrodes. However, the HER current decreases rapidly on the Pt/C electrode. FIG. 4*c* shows the evolution of the HER current as a function of the CA time. It is clear that the HER current decreases rapidly on the Pt/C electrode, while it remains stable on the Cu—Pt/Ti electrode. After 24 h, the Pt/C only retains 19% of its initial activity while the Cu—Pt/Ti electrode fully retains its activity. Furthermore, the mass activity of Pt/C and Cu—Pt/Ti electrodes after 24 hours of operation has been compared. As shown in FIG. 4*d*, the Cu—Pt/Ti electrode outperforms the Pt/C one by a factor of 14. Overall, these experiments clearly indicate the superior stability of the Cu—Pt/Ti electrode under high HER current conditions (−142 mA/cm$^2$ of HER current). In order to understand the reason behind the excellent stability of the Cu—Pt/Ti catalyst and the poor stability of the Pt/C one HERTEM characterizations on the electrodes after stability tests have been also performed. As shown in FIG. 5*a*, the Cu—Pt/Ti catalyst is still composed of small Cu and Pt nanocrystals, while Pt/C shows severe aggregation of Pt particles over the carbon support (FIG. 5*b-c*). It can be hypothesized that the structural instability of Cu support (dynamic restructuring) prevents Pt nanoparticles from aggregation and thus it can maintain its catalytic activity for prolonged time durations.

Example 6

In Situ Preparation of the Electrocatalyst

As a first step, CuO nanoplatelets were deposited on a Ti substrate by means of a low temperature wet chemical approach as described in Example 1. After completing the reaction, the black CuO-coated Ti substrate was removed, washed with deionized water, and dried with a stream of air.

The CuO—Ti support thus obtained was then used as a working electrode for HER in a 3-electrode electrochemical cell (further comprising a Pt wire as a counter electrode and a double-junction Ag/AgCl (3.8 M KCl) as reference electrode) using a 1 M NaOH solution in water as the electrolyte solution. Then, a potassium hexachlororuthenate(IV) solution (1 mg/ml $K_2RuCl_6$ solution in water) was added in an amount of 100 μL to the electrolyte solution. A potential of −1.2 V with respect to the Ag/AgCl (3.8 M KCl) electrode was applied to the cell in order to start the electrodeposition of Ru. Of particular importance, no precipitate was observed in the electrolyte bath upon the addition of $K_2RuCl_6$, indicating that the complex salt of Ru is soluble in the 1 M NaOH solution.

Example 7

Chronoamperometry (CA) and LSVs

Figure 6A:
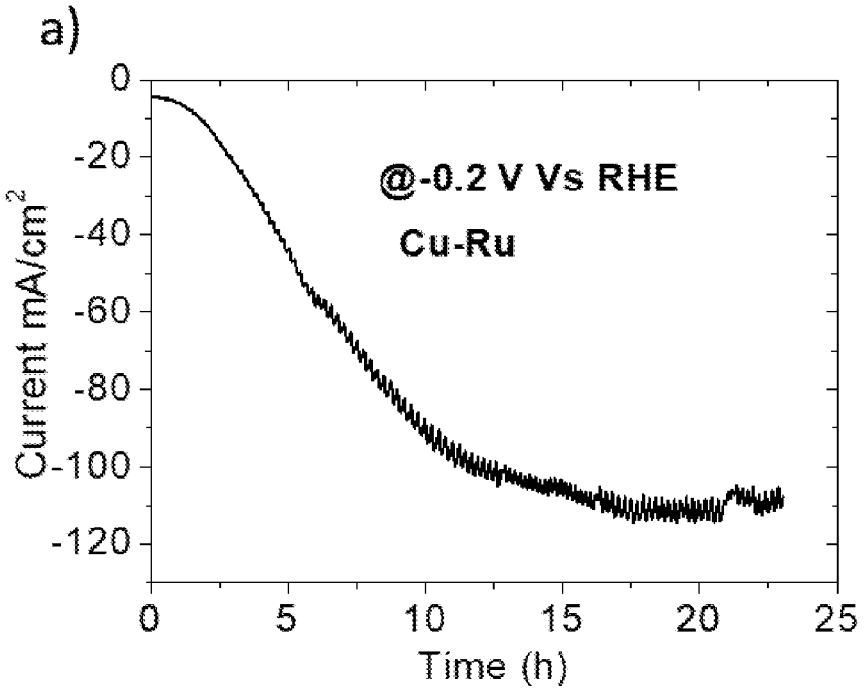
FIG. 6*a* shows the evolution of the current as a function of the CA time at an applied potential of −0.2 V vs RHE of the electrocatalyst obtained by employing 100 μL of a 1 mg/ml $K_2RuCl_6$ solution as described in Example 6.

FIG. 6*a* shows the chronoamperometry (CA) plots of Cu—Ti electrodes immersed in 30 ml of 1 M NaOH electrolyte solution upon the addition of an amounts of 100 μL of the 1 mg/ml $K_2RuCl_6$ solution in water as described in Example 6. As in the case of the Cu—Pt/Ti electrocatalyst of Example 2, the current increases during the first 15 hours eventually stabilizing afterward, without any further increase and, interestingly, the increase in the current is followed by a vigorous hydrogen evolution from the electrode. This result demonstrates the efficiency of the Cu-M/Ti electrocatalyst (M=noble metal) for hydrogen production via hydrogen evolution reaction under basic condition in the case of ruthenium too (M=Ru).

Figure 6B:
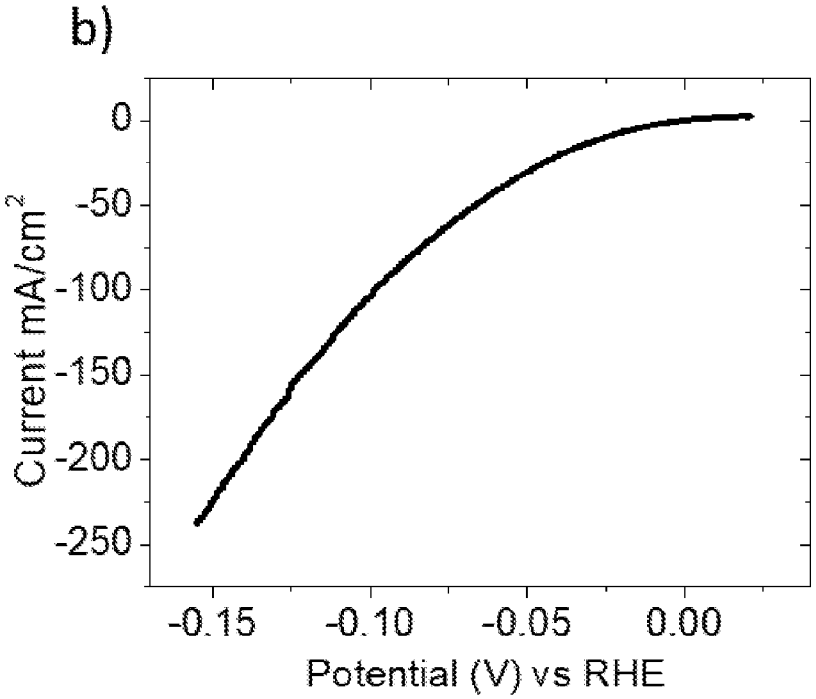
FIG. 6*b* shows the HER activity of the electrocatalyst obtained by employing 100 μL of a 1 mg/ml $K_2RuCl_6$ solution as described in Example 6, measured by LSVs.

FIG. 6*b* shows LSV of the Cu—Ru/Ti electrode of Example 6 measured at a scan rate of 10 mV/s. This voltammogram is comparable with the one obtained for the Cu—Pt/Ti electrocatalyst of Example 4 and shown in FIG. 4*a*, as also in this case the Cu—Ru electrode current rises rapidly and reach comparable values. As in the case of the Cu—Pt electrode, this can be attributed to the same highly porous nature of the Cu—Ru/Ti electrode, which enables the electrolyte to easily access active sites, the formed hydrogen bubbles to readily escape from the catalyst's surface.

The invention claimed is:

1. An electrocatalyst comprising a Ti substrate coated with a 3D Cu nanostructured matrix decorated with a mixture of amorphous $TiO_2$ nanoparticles and nanoparticles of platinum (Pt).

2. Electrocatalyst according to claim 1, wherein the nanoparticles of platinum (Pt) have a loading density of between 30 and 60 $\mu g/cm^2$.

3. Electrocatalyst according to claim 1, wherein the nanoparticles of platinum (Pt) have a mean diameter measured by HRTEM technique of between 0.5 and 4 nm.

4. Electrocatalyst according to claim 1, wherein the amorphous TiO2 nanoparticles have a mean diameter measured by HRTEM technique of between 0.5 and 10 nm.

5. Electrocatalyst according to claim 1, wherein the 3D Cu nanostructured matrix forms a layer on the Ti substrate, said layer having a thickness of between 500 and 1000 nm.

6. Electrocatalyst according to claim 1, wherein the nanoparticles of platinum (Pt) have a loading density of between 40 and 55 $\mu g/cm^2$.

7. Electrocatalyst according to claim 1, wherein the nanoparticles of platinum (Pt) have a mean diameter measured by HRTEM technique of between land 3 nm.

8. Electrocatalyst according to claim 1, wherein the amorphous TiO2 nanoparticles have a mean diameter measured by HRTEM technique of between 1 and 6 nm.

9. Electrocatalyst according to claim 1, wherein the 3D Cu nanostructured matrix forms a layer on the Ti substrate, said layer having a thickness of between 600 and 900 nm.

10. An in situ process for the preparation of the electrocatalyst according to claim 1 and simultaneous production of hydrogen comprising the steps of:

(a) providing an electrochemical cell having a 3-electrode configuration comprising a starting working electrode which comprises a Ti substrate coated with vertically oriented CuI nanoplatelets, the cell further comprising a counter electrode and a reference electrode;

(b) adding an aqueous basic electrolyte solution to the cell of step (a), said aqueous basic electrolyte solution comprising a precursor of platinum (Pt);

(c) applying a negative potential with respect to the reference electrode to the cell of step (b).

11. Process according to claim 10, wherein said negative potential is between −1.2 and −1.4 V.

12. Process according to claim 10, wherein the aqueous basic electrolyte solution of step (b) is in a concentration of between 0.1 M and 1 M and is selected from the group consisting of NaOH, KOH, and LiOH aqueous solutions.

13. Process according to claim 10, wherein the aqueous basic electrolyte solution of step (b) is in a concentration of between 0.1 M and 1 M.

14. Process according to claim 10, wherein the precursor of platinum (Pt) is in a concentration of between 0.2 and 10 $\mu g/ml$.

15. Process according to claim 10, wherein the CuO nanoplatelets of step (a) are deposited on the Ti substrate by a low-temperature solution deposition process comprising:

(a.I) providing an aqueous solution comprising copper salt and ammonia;

(a.II) immersing the Ti substrate into said solution and heating to a temperature comprised between 6° and 90° C. to form copper-ammine complexes, which decompose and lead to a heterogeneous nucleation of vertically oriented CuO nanoplatelets on the substrate.

16. Process according to claim 10, wherein, in step (c), the reference electrode is a double junction Ag/AgCl (3.8 M KCl) reference electrode and the negative potential applied with respect to said reference electrode to the cell of step (b), is a negative potential of between −1.1 and −1.5 V.

17. Electrochemical cell having a 3-electrode configuration comprising the electrocatalyst according to claim 1 as the working electrode, a counter electrode, a reference electrode and an aqueous basic electrolyte solution, optionally comprising a precursor of platinum (Pt).

18. A process for producing hydrogen comprising:

providing an electrochemical cell according to claim 17; and applying a negative potential with respect to the reference electrode to the cell.

* * * * *